United States Patent [19]

Bagwell

[11] Patent Number: 4,684,062

[45] Date of Patent: Aug. 4, 1987

[54] PUMPING SYSTEM FOR MOBILE PROTECTIVE COATING SPRAY APPARATUS AND OTHER APPLICATIONS

[75] Inventor: Maury L. Bagwell, Carrollton, Ga.

[73] Assignee: Neal Manufacturing Company, Inc., Villa Rica, Ga.

[21] Appl. No.: 749,759

[22] Filed: Jun. 28, 1985

[51] Int. Cl.[4] ..... B05B 17/04; B05B 1/20

[52] U.S. Cl. ..... 239/1; 91/275; 239/159; 239/332

[58] Field of Search ..... 239/159, 163, 164, 169, 239/172, 175, 1, 11, 332; 417/403; 91/275

[56] References Cited

U.S. PATENT DOCUMENTS

| | | | |
|---|---|---|---|
| 3,776,252 | 12/1973 | Wilcox | 417/403 |
| 4,028,014 | 6/1977 | Cocks | 417/403 |
| 4,161,659 | 7/1979 | Jacob | 361/180 |
| 4,176,586 | 12/1979 | Stoll et al. | 91/275 |
| 4,198,820 | 4/1980 | Roth et al. | 91/275 |
| 4,230,023 | 10/1980 | Ward | 91/275 |
| 4,311,274 | 1/1982 | Neal | 239/172 |
| 4,609,045 | 9/1986 | Rogers | 91/275 |

FOREIGN PATENT DOCUMENTS

| | | | |
|---|---|---|---|
| 2027875 | 12/1971 | Fed. Rep. of Germany | 417/403 |

*Primary Examiner*—Andres Kashnikow
*Assistant Examiner*—Michael J. Forman
*Attorney, Agent, or Firm*—Van C. Wilks

[57] ABSTRACT

Disclosed herein is an improved pumping system for self-contained and, if desirable, portable machines adapted to efficiently spray or squeegee viscous sealing fluids on roadway pavement and parking lots, which fluids may contain suspended solid matter. For example, this fluid pumping assembly is especially suitable for spraying asphaltic or coal-tar-pitch emulsions containing sand onto asphalt road surfaces. Also disclosed is an improved hydraulic drive cylinder assembly and control means therefor employing an improved electrically controlled hydraulically operated drive network.

27 Claims, 7 Drawing Figures

FIG. 2
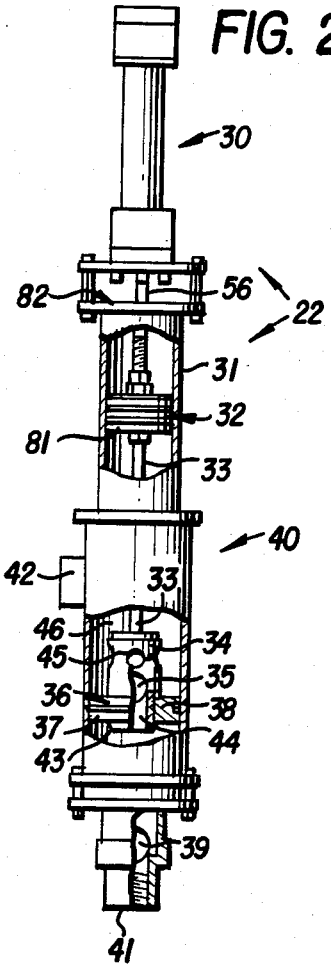
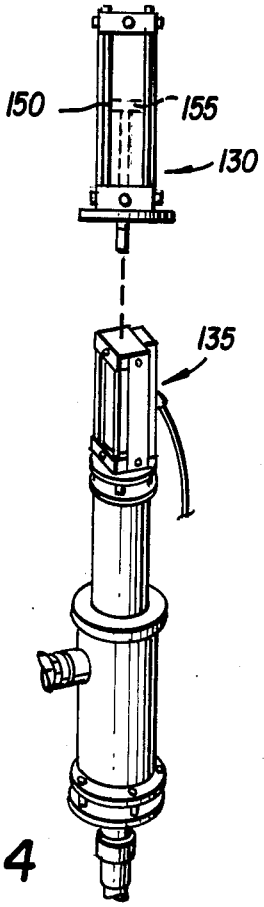
FIG. 4
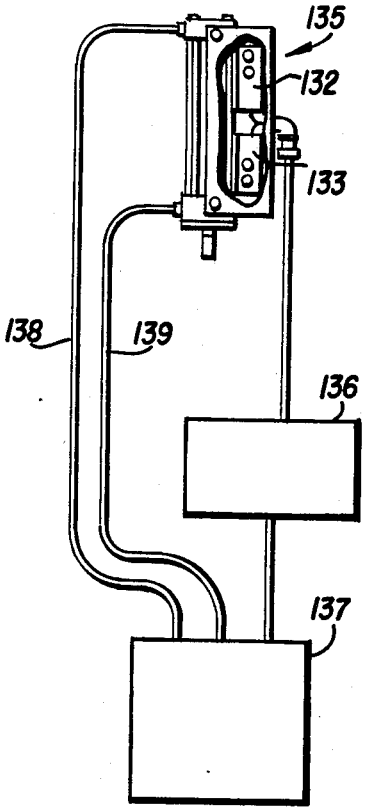
FIG. 5
FIG. 6
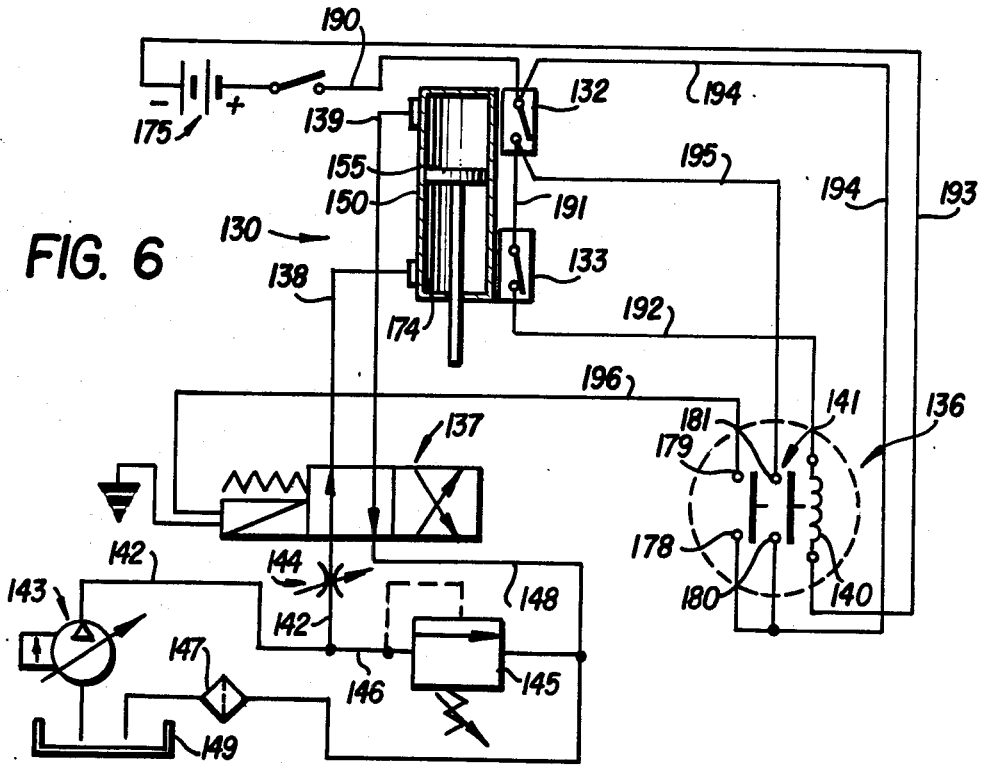

PUMPING SYSTEM FOR MOBILE PROTECTIVE COATING SPRAY APPARATUS AND OTHER APPLICATIONS

BACKGROUND OF THE INVENTION

This invention relates first of all to fluid spraying apparatus and more particularly to an improved, portable, self-contained viscous liquid spraying apparatus incorporating a new and improved pumping system for pumping the viscous liquid out through the spray applicator. By way of example, the pumping arrangement invented and disclosed herein can provide an improved pumping arrangement for the mobile spray apparatus disclosed in U.S. Pat. No. 4,311,274 of a common assignee to the instant invention. The pump assembly of the instant invention is especially adapted to spray the asphaltic emulsions and coal-tar-pitch emulsions mixed with sand and disclosed and discussed in U.S. Pat. No. 4,311,274. Secondly, invented and disclosed herein is an improved vertical lift double acting piston pump that reciprocates by utilizing alternate acting magnetically responsive switches to achieve reciprocation and incorporates an unique control mechanism comprising a combination electric and hydraulic network.

OBJECTS AND SUMMARY OF THE INVENTION

It is an object of the present invention to provide an improved pumping arrangement for a mobile spray apparatus.

It is a further object of the present invention to provide an improved, self-contained, portable apparatus adapted to efficiently apply viscous sealing fluids on roadway pavement and parking lots.

It is also an object of the present invention to provide an improved pumping apparatus for spraying asphaltic or coal-tar-pitch emulsions or other heavy liquids sometimes containing suspended sand onto asphalt surfaces.

It is also an object of the present invention to provide an improved electrically controlled hydraulically operated drive cylinder employing a magnetized piston in combination with a device to be driven by reciprocating movement.

A further object of the present invention is to provide a mobile spraying apparatus having an improved fluid pumping assembly and control means employing an electrically controlled hydraulically operated drive means for the pump.

DESCRIPTION OF THE DRAWINGS

FIG. 2 is a section view of one pumping assembly employing a known prior art hydraulic cylinder drive mechanism.

FIG. 4 is a partial section view of one embodiment of the hydraulic piston and cylinder fluid pumping assembly of the present invention.

FIG. 5 is a partial schematic, partial actual view of one embodiment of the cylinder and pump drive mechanism of my invention.

FIG. 6 is a schematic of the hydraulic network and electrical network of the electrically controlled and hydraulically operated drive cylinder assembly of the present invention.

DESCRIPTION OF THE PREFERRED EMBODIMENT

Figure 1:
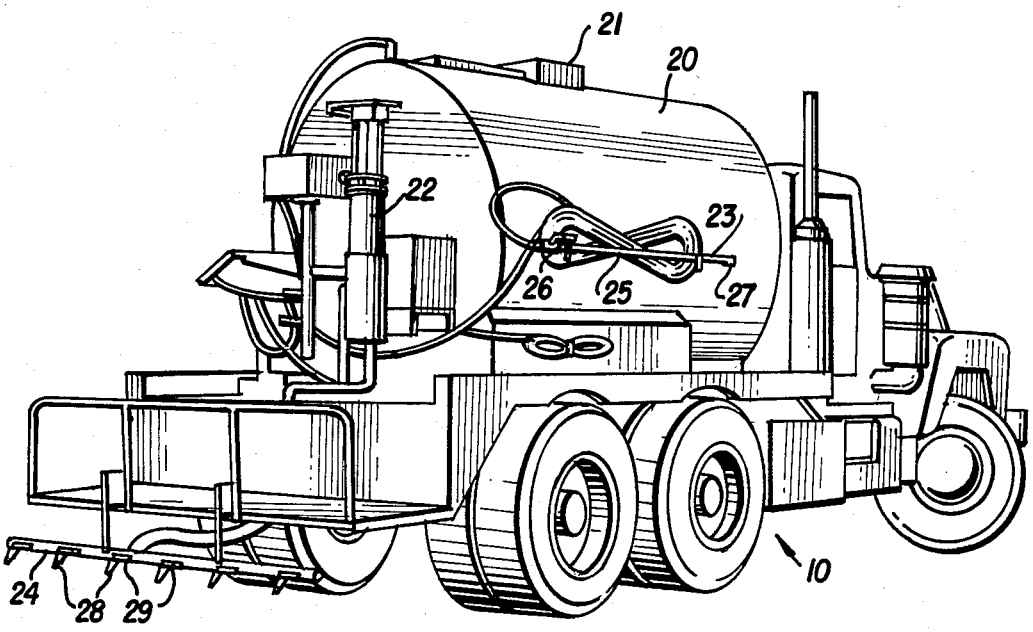
FIG. 1 depicts a typical portable fluid spraying apparatus that can, if applicable, be used to mount the present invention.

As illustrated in the drawings, the fluid spraying apparatus of the prior art, and the closest prior art of which I am aware, is established and produced by the assignee of the present invention, and comprises, generally, a portable support means 10 (FIG. 1), which generally is either truck (shown), skid or trailer mounted supporting a sealing fluid reservoir 20 having a fill port 21 at the top for receiving materials to be sprayed and having a sealing fluid pumping assembly 22 for pumping the sealing fluid from the bottom of reservoir 20, thence up through the pumping assembly which delivers the pressurized fluid to selectively alternate (through valve means not shown) spray means 23, 24. Spray means 23 is, for example, for smaller areas, and includes spray wand 25 carrying on-off control 26 and discharge nozzle 27. Nozzle 27 may be a Model 8050 Veejet spray nozzle manufactured by Spraying Systems, Inc. of Wheaton, Ill., and is specifically designed to generate a flat, wide-angle spray pattern. Spray means 24 is the primary spray means and comprises a spray bar having, in the illustration shown, six nozzles 28 carrying individual on-off control levers 29. Nozzles 28 may be Model 8070 Veejet spray nozzles manufactured by Spraying Systems, Inc., and are also designed to generate a flat, wide-angle spray pattern.

Referring now to FIG. 2, the pumping assembly 22 of the typical prior art device is comprised more specifically of a pumping assembly hydraulic drive cylinder 30 typically approximately two inches in diameter, a vertical lift double acting piston pump 40 comprising an upper pump housing 31 containing upper plunger assembly 32 shown with three leather seals 81 separated by spacers which assembly is connected in approximately vertical perpendicular alignment to the earth through pump shaft 33 to pumping head cage 34 containing a pumping head or upper check ball valve 35 shown seated on its perpendicularly aligned seat. Also connected to pumping head 34 is lower plunger assembly 36 having two leather seals 37, the lower plunger assembly sliding in sealing engagement with the sides of the lower pump housing 38. The bottom of the pump assembly 22 is fitted with an inlet or lower check ball valve 39 which rests on its perpendicularly aligned seat during the downward stroke of the pump shaft 33 and pumping head cage 34. Coating fluid enters the pumping assembly from the bottom at inlet port 41 and discharges through outlet port 42 and then flows to the selectively alternate spray means described above.

In operation, pump shaft 33 of the fluid pumping assembly is raised through the action and power generated by the hydraulically raised piston within hydraulic drive cylinder 30. In the upstroke of shaft 33 caused thereby, check ball valve 35 is caused to seat against the seat portion of pumping head cage 34 and sealing fluid is thereby simultaneously blocked by lower plunger assembly 36 and lifted by the lower plunger assembly 36 and caused to discharge through outlet port 42 and on to the selectively alternate spray means described above which thereafter may distribute the sealing fluid on a road or parking lot surface. When the piston in the fluid pumping assembly's hydraulic drive cylinder 30 reaches the upper end of its vertical (perpendicular to the earth) stroke, it is then caused to descend (as will be explained in more detail hereinafter) by redirecting the hydraulic fluid which is under a separate pump's separately generated hydraulic pressure thereby supplying the drive cylinder its power. As the piston inside drive cylinder 30 descends, pump shaft 33 which is linearly aligned (preferably vertically, as will be explained hereinafter) and connected therebelow, descends and members 32, 34, 36 descend inside housings 31, 38. During the descent, the fluid which has been sucked into pump chamber 43 on the upstroke is compressed against lower check ball valve 39 causing ball 39 to seat on its perpendicularly aligned seat to thereby close off the back flow of spray fluid to the reservoir by resting in sealing engagement on its seat. The pressure thereby generated in the sealing fluid in chamber 43 simultaneously forces check ball valve 35 to rise off its seat, and the fluid (which is simultaneously being compressed by the downward movement of upper plunger assembly 32) is thus pumped and caused to pass up through passage 44 in the center of pumping head cage 34 and out of a plurality of outlets 45 in cage 34 and into the upper pump chamber 46, that portion of fluid not already having discharged being ready to be discharged through discharge port 42 on the next upstroke of the pump shaft 33.

Figure 3:
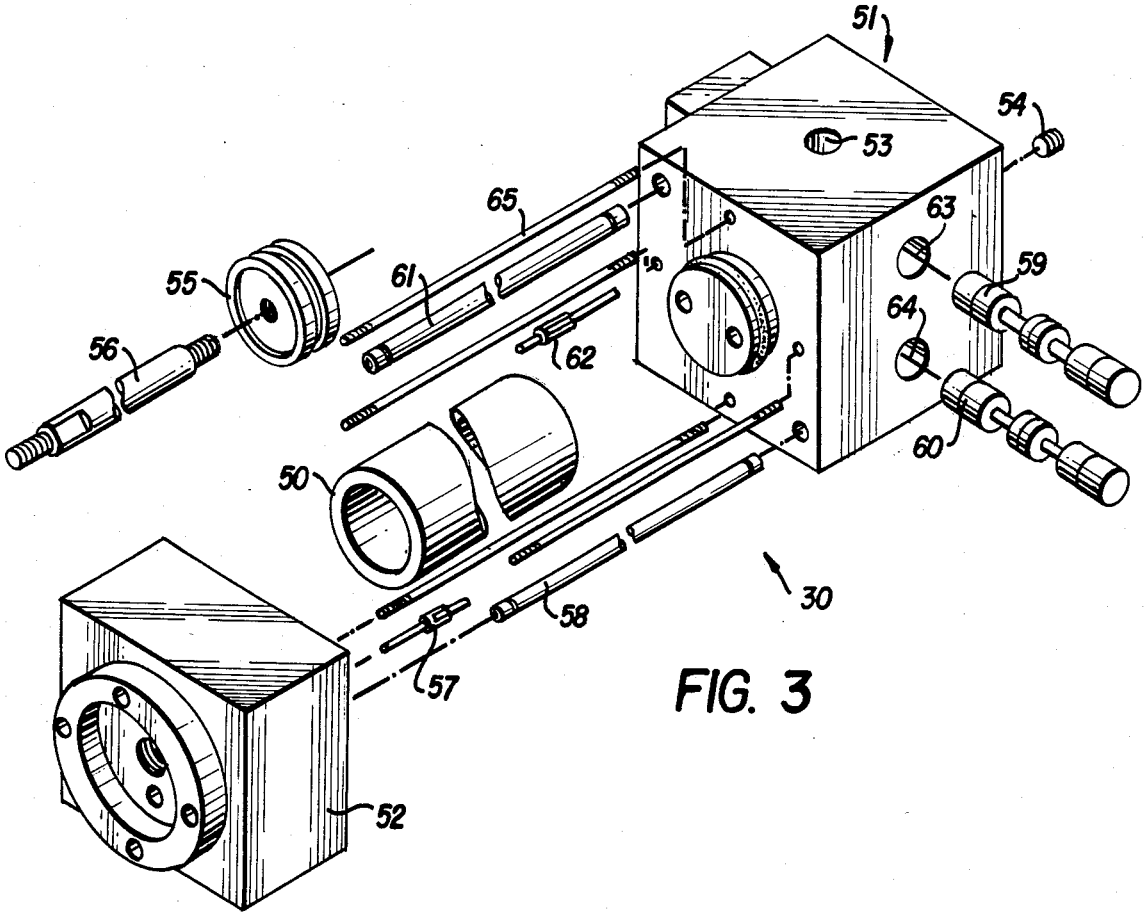
FIG. 3 is an exploded view of one prior art hydraulic piston and cylinder assembly for driving one prior art vertical lift double acting piston pump.

Turning now to FIG. 3 in order to see the details of a hydraulic drive cylinder assembly 30 of the prior art, one such hydraulic cylinder has been a two-inch diameter steel cylinder 50 containing a steel piston 55 and rod 56 inside and having a top cap 51 and a bottom cap 52 of a softer metal such as aluminum and being primarily held together by a plurality of steel tie rods 65. One hydraulic drive cylinder assembly has been manufactured by Jevco Manufacturing Company of Sarasota, Florida. The prior art hydraulic drive cylinder assembly is hydraulically controlled and hydraulically operated by a single pump-pressurized input hydraulic line which connects to hydraulic oil input port 53 and has a single return hydraulic line (also not shown, but connected in line with plug 54) to the hydraulic pressure generating means which may be a hydraulic oil pump. In operation, the hydraulic drive cylinder assembly 30 is supplied hydraulic fluid under pressure through the supply port 53 which causes the hydraulic drive cylinder's piston assembly 55, 56 which comprises steel piston 55 and hydraulic cylinder piston rod 56 slidingly mounted within cylinder 50 to descend on its vertically aligned course (that is, move to the left in FIG. 3) in the down stroke of the fluid pumping assembly 22. As the piston 55 descends, it comes into physical contact with a lower shifting pin 57 made of hardened steel alloy or the like. The lower surface of piston 55 abuts and moves lower shifting pin 57, which is hydraulically connected through pilot pressure tube 58 back to top cap 51 wherein it is further connected to two pilot pressure operated reciprocating control spool valves 59, 60 sliding on axes 63, 64 respectively. The lower shifting pin thus moves downward due to the physical contact with piston 55 thereby releasing the pilot pressure in tube 58, thereby communicating this released pressure to spool valves 59, 60, thus shifting the control spools 59, 60, and redirecting the flow of hydraulic fluid within top cap 51 through an interconnecting network of hydraulic fluid flow passages (not shown). This causes the continued flow of the hydraulic fluid created by the continued pressure applied by the hydraulic oil supply pump (not shown) to be redirected as a result of said spool valve shift to traverse down pilot pressure tube 61 to a position underneath piston 55 and this occurs at the point when the piston 55 reaches its approximate maximum down stroke, so that further hydraulic pressure starts the upstroke of the piston assembly 55, 56, and thus the upstroke of the hydraulic drive cylinder assembly 30, by continuing to flow hydraulic fluid through port 53 and down tube 61. This action raises piston 55 and piston rod 56 and consequently the pump shaft 33 (which is coaxially aligned with and joined to the end of piston rod 56 by cooperating threads). When the hydraulic piston 55 traverses its full upward stroke, it comes into physical contact with alloy steel upper shifting pin 62 thereby causing the upper shifting pin to also move upward to thereby again release the established pilot pressure and realign the pilot pressure operated control spools 59, 60 within top cap 51. Typically, control spools 59, 60 are pressure operated and are not spring loaded. The continued, unidirectional pressurized flow of hydraulic fluid from the hydraulic pump now again reverses the movement of the drive cylinder's piston assembly 55, 56 resulting in a continuous operating cycle due to the continuous shifting of control spools 59, 60 responsive to the continuous application and release of pilot pressure through tubes 58, 61. One deficiency with the prior art device is the fact that the shifting pins 57, 62 are, as I stated, usually made of hardened steel alloy while the cylinder caps 51, 52 are usually made of a softer metal such as aluminum. Over a period of time the end caps, being manufactured of softer metal, wear faster, thereby ultimately causing a malfunction in the hydraulic drive cylinder assembly such as uncontrolled and hard to remedy "short stroking" when the piston only travels part of the intended distance down the cylinder before commencing its return stroke and such change of direction being independent of shift pin actuation. This situation is caused by the pilot pressure's leaking around the pin 57 (or 62) prematurely because of the seat of the pin being deformed by the repeated pounding of the hardened steel pin against the (typically) aluminum seat (not shown). In a normal field maintenance situation, "short stroking" can only be remedied by removal and replacement of the complete hydraulic drive cylinder assembly unit, causing excessive and costly down time.

In contradistinction to the prior art, the hydraulic drive cylinder assembly of my fluid pumping assembly is electrically controlled and hydraulically operated to obviate shortcomings in the prior art hydraulically controlled, hydraulically operated devices.

One embodiment of my new and improved fluid pumping assembly and hydraulic drive cylinder assembly is disclosed in FIG. 4. My improved hydraulic drive cylinder assembly 130 is comprised of a drive cylinder tube 150 made of non-magnetic material such as brass, for example, two-inches in diameter. In order to obviate the heretofore described shortcomings of the prior art mechanical shifting pins wearing out their seats, I employ upper 132 and lower 133 electro-magnetic switches (see FIG. 5) which, for example, may be "Go" Proximity Limit Switches Model 211110 manufactured by General Equipment and Manufacturing Company, Inc., of Louisville, Ky. These proximity switches are capable of sensing the presence of the hydraulic drive piston 155, which is made of unmagnetized ferrous material such as steel, through the non-magnetic wall of the cylinder 150. When the unmagnetized ferrous piston 155 passes through the magnetic field generated by and surrounding the proximity limit switches 132, 133, the internal workings of each switch are magnetically and physically unbalanced and each switch switches from its primary (normal) position to its secondary (alternate) position. In my preferred embodiment, in its primary position the magnetic field surrounding upper proximity switch 132 is set or wired such that electro-magnetic switch 132 is normally open, that is, will not permit the passage of electrical current, and electro-magnetic switch 132 is wired in series with lower electro-magnetic proximity switch 133 which, in its primary (normal) position, has its magnetic field set or wired such that switch 133 is normally closed, that is, normally can carry electrical current. The "closed" or "open" position is achieved by the leads one selects to wire into the electrical network in proximity switches that come from the supplier as combination "closed" or "open" proximity switches. There are also some manufacturers of magnetic proximity switches which supply them as only either "closed" or "open" and one would connect the electrical leads of these switches accordingly. The electric current carried by these switches can be of a signal voltage and signal amperage level. Electrical wiring up to several feet in length connect the two electro-magnetic proximity limit switches 132, 133 of the hydraulic drive cylinder mounted switch bracket assembly 135 to relay assembly 136 which is located up to several feet remote from the hydraulic reciprocator cylinder 130 and its switch bracket assembly 135. The details of the relay assembly will be more particularly described hereinafter. The relay assembly 136 is in turn electrically connected by up to several feet of wire to a remotely located solenoid directional valve assembly 137 which contains a solenoid valve, and which, in response to electrical impulses, directs hydraulic fluid alternately to the upper chamber and then to the lower chamber of the hydraulic drive cylinder assembly 130 so as to create the necessary continuous upstroke and downstroke sufficient to drive, for example, a vertical lift double acting piston pump and fluid pumping assembly. Hydraulic lines 138, 139 connect the solenoid directional valve assembly 137 with the lower and upper chambers (see FIG. 6), respectively, of the hydraulic drive cylinder assembly 130.

Further details of the combination electric and hydraulic control network of the present invention are shown in FIG. 6 which is shown in schematic representation and is more particularly described hereinafter. As mentioned previously, and as can be seen in FIG. 6, upper proximity switch 132 is normally "open," or, in other words, does not complete an electrical circuit while lower proximity switch 133 is normally "closed," or in other words, can normally make a complete electrical circuit, and the two switches are wired in series through electrically conductive wire 191. Also shown schematically in FIG. 6 is electrical relay assembly 136 containing relay coil 140 and also containing, for example, double pole, double throw switch assembly 141 which is moved into either make-contact position or break-contact (as shown) position when relay coil 140 is, respectively, energized or deenergized (as shown) in the electrical circuit which is connected to direct current power source 175, which may be a 12-volt automobile battery or the like carried by the mobile apparatus. In the preferred embodiment of my invention I use a single solenoid directional valve assembly 137 of the two position spring offset type which is shown schematically in FIG. 6 in a first, deenergized (the spring is deenergized) position in which hydraulic fluid in hydraulic line 142 is supplied to the lower chamber 174 of non-magnetic hydraulic cylinder tube 150 from a variable volume pressure compensated hydraulic pump 143 connected to said lower chamber through hydraulic line 142, valve assembly 137, and hydraulic line 138. I have specifically coupled this single solenoid directional valve assembly 137 with appropriate electrical relay assembly 136 in order to establish efficient and positive means of reciprocation so that the hydraulic drive cylinder of my invention cannot stall in mid-stroke. By positive I mean that the system is coordinated so there is no possibility for the piston 155 to be caught at some intermediate position that is neither at the top or the bottom of the stroke. This has been found particularly advantageous over prior art systems such as shown in FIGS. 2 and 3 which can stall mid-stroke because of the accumulation of foreign material or wear-created rough areas on spool valves 59, 60. My control network, on the other hand, and as will be explained in more detail hereinafter, is coordinated between the relay 136 and the solenoid valve 137 so that piston 155 automatically returns to the up position (along side switch 132) when solenoid valve 137 and relay 136 are deenergized. This is important because if upper plunger assembly 32 is inadvertently permitted by the equipment operator to stop for a prolonged period in the down position, the residue of the viscous material being pumped hardens on the inside surface of upper pump housing 31 and when the fluid pumping assembly 22 is restarted from its thus created downstroke position, leather seals 81 are damaged from the contact with the encrusted material during the upstroke. The encrustation process is accelerated by the fact that the vertical lift double acting piston pump 40 is open to the atmosphere at point 82 to accommodate weep loss and facilitate mechanical access.

Hydraulic fluid is directed through line 142, valve 137, and line 138 to raise the unmagnetized ferrous piston 155. Hydraulic pump 143 is, by my selection, a variable volume pressure compensated hydraulic pump, one such pump presently on the market being the PAVC series variable piston pump manufactured by Parker Hannifin Corporation, Cleveland, Ohio. Parker Hannifin also manufactures a solenoid directional control valve which may be used as such in practicing my invention. The pump will run at a certain, constant, pre-set speed but the displacement of the variable volume pressure compensated hydraulic pump 143 is controlled by needle valve 144 or the like which is adjusted to either increase or decrease the volume of hydraulic fluid flowing out of the pump and through hydraulic line 142.

The purpose of the pressure compensated variable volume pump 143 is to allow the flow and pressure requirements of the material pump 40 to regulate, through an interacting feedback mechanism that will be explained hereinafter, the whole hydraulic system and this results in efficient operation and finite control of my fluid pumping assembly 22. An abrupt closing off of on-off valve 26, during operation, immediately causes pressure buildup in the viscous coating materials in piston pump 40 causing the condition referred to as "dead headed". However, because of my use of a variable volume pressure compensated pump 143, the engine (not shown) driving the pump 143, which may be a conventional internal combustion engine, will "unload" or start racing and then subsequently slow down in response to the fact that the load created by the pump 143 diminishes.

In operation material enters the material pump 40 at inlet 41 and is then discharged through the discharge port 42, as the pump is constantly replenished from the reservoir 20 as the plunger assemblies are hydraulically driven up and down by the hydraulically operated electrically controlled drive cylinder assembly 130. As the fluid material is discharged it is either directed to the material spray wand 23 having nozzle 27 or the distributor bar 24 having nozzles 28. The system is designed so that the viscous material is generally being discharged from the spray wand or the spray bar at a volume less than that being generated and supplied to the materials spraying system by the material pump 40. The resulting over supply of viscous material upstream of the on-off valve causes a substantial rise in material pressure causing a resulting rise in hydraulic pressure in the hydraulic drive system. As the hydraulic pressure builds such as, for example, when the operator starts closing down the on-off valve, and responsive to that rise, the variable volume hydraulic pump begins to reduce its volume of hydraulic fluid being pumped in order to maintain a preset, maximum compensated pressure, which may be, for example, approximately 650 psi. This, in turn, reduces the hydraulic oil supply to the reciprocating cylinder thereby causing the drive cylinder to reduce its speed (that is, reduce its number of reciprocations per minute) thereby reducing and regulating the speed of the materials pump 40 and consequently the material pressure in the materials distribution line at the on-off valve. The hydraulic pump 143 will continue to reduce its volume as long as the material pressure continues to climb to, ultimately, for example, approximately 70 psi. This would occur at the point where material discharge has been cut off all together resulting in a complete reduction, theoretically to zero, of the supply of hydraulic fluid to the reciprocating cylinder mechanism 130. Theoretical zero is not achieved, however, because a very small amount of hydraulic oil is required to make up internal leakage and inefficiencies and to maintain a preset material pressure. By "preset material pressure" I mean a maximum pressure in the materials discharge line, for example, approximately 70 psi, corresponding to a maximum preset design pressure in the hydraulic network driving said cylinder assembly, of, for example, approximately 650 psi. When the materials discharge system is again turned on by the operator, the material pressure falls immediately causing the variable volume pressure compensated pump 143 to again begin to supply the hydraulic drive cylinder 130 with hydraulic fluid to maintain material pressure in response to the volume of material flow. This system, therefore, through adjustment of needle valve 144, provides a means of efficient speed control possessing an infinite intermediate speed regulation, for example, from between 0 and 60 cycles per minute of the drive cylinder assembly 130.

I employ a relief valve 145 in bypass line 146 to limit maximum pressure in the hydraulic drive system of my invention to a safe limit. In my opinion, the addition of this relief valve is necessary for the safe use of a variable volume pressure compensated hydraulic pump in my application. Member 147 is an optional hydraulic fluid filter. Hydraulic fluid return line 148 connects with upper chamber hydraulic line 139 when solenoid valve 137 is in its first, denergized position as shown in FIG. 6. Return line 148 returns hydraulic fluid such as oil to the pump's hydraulic fluid reservoir or sump 149.

In operation, when unmagnetized but magnetic piston 155 is in its fully retracted state (fully up as viewed in FIG. 6 and retracted into non-magnetic cylinder 150), electro-magnetic proximity limit switch 132, which as stated previously is normally open, that is, will not permit the passage of electrical current, is caused to make contact (is caused to close to permit the passage of electrical current) because of the presence of the piston 155, which, because it is made of magnetic material, interrupts the normal magnetic field provided by and associated with switch 132 allowing switch 132 to close. Since switch 132 and switch 133 are wired in an electrical series arrangement and switch 133 is, as stated previously, a normally closed switch (that is, will permit the passage of electrical current), the circuit from electrical current source 175 is completed through electrical wire 190, switch 132, wire 191, switch 133, and wire 192 to coil 140 and wire 193 from coil 140 back to the current source thereby causing relay coil 140 to energize closing electrical contacts 178, 179 of electrical relay assembly 136 thereby energizing solenoid valve 137 into its second or energized position through wire 190, wire 194, contacts 178, 179, and wire 196. Solenoid 137 is grounded (as shown) to complete the electrical circuit. The other set of electrical contacts 180, 181 within electric relay 136 is also closed by energized coil 140 and is thereby connected in what I call a latching or self-holding arrangement of the relay coil 140 and relay assembly 136 which permits relay coil 140 to remain electrically connected and energized even after the piston 155 leaves the magnetic sensing range of proximity switch 132 causing switch 132 to physically reopen. At this point in my cycle, even though switch 132 has just reopened, the coil 140 is still latched in its electrically connected energized position through circuit wire 190, wire 194, across contacts 180, 181, through wire 195, wire 191, closed switch 133, and wire 192 to coil 140 and wire 193 from the coil 140 back to the negative side of direct current energy source 175. When the unmagnetized but magnetic piston 155 proceeds further and approaches proximity switch 133 on its downward decent, proximity switch 133 is caused to open (break contact) thereby breaking one link in the just-described circuit and releasing relay coil 140 and relay assembly 136 from a complete circuit connection to current source 175. The release of coil 140 also breaks contacts 178, 179 which in turn releases solenoid valve 137 allowing the spring of the solenoid valve to shift the spool inside solenoid valve 137 back into its normal position (the position shown in FIG. 6) reversing the flow of pressurized hydraulic oil from variable volume hydraulic pump 143 and consequently the direction of movement of piston 155. As the piston 155 now traverses its ascent back upward to its retracted position and breaks the magnetic field of switch 132, proximity switch 132 is actuated into its closed position preparatory to beginning the cycle once again. Thus, the electrical latching circuit of my control network prevents the piston 155 from becoming inoperatively caught at some intermediate position within cylinder 150 even though relay 136 may become deenergized from some malfunction of the apparatus.

Figure 7:
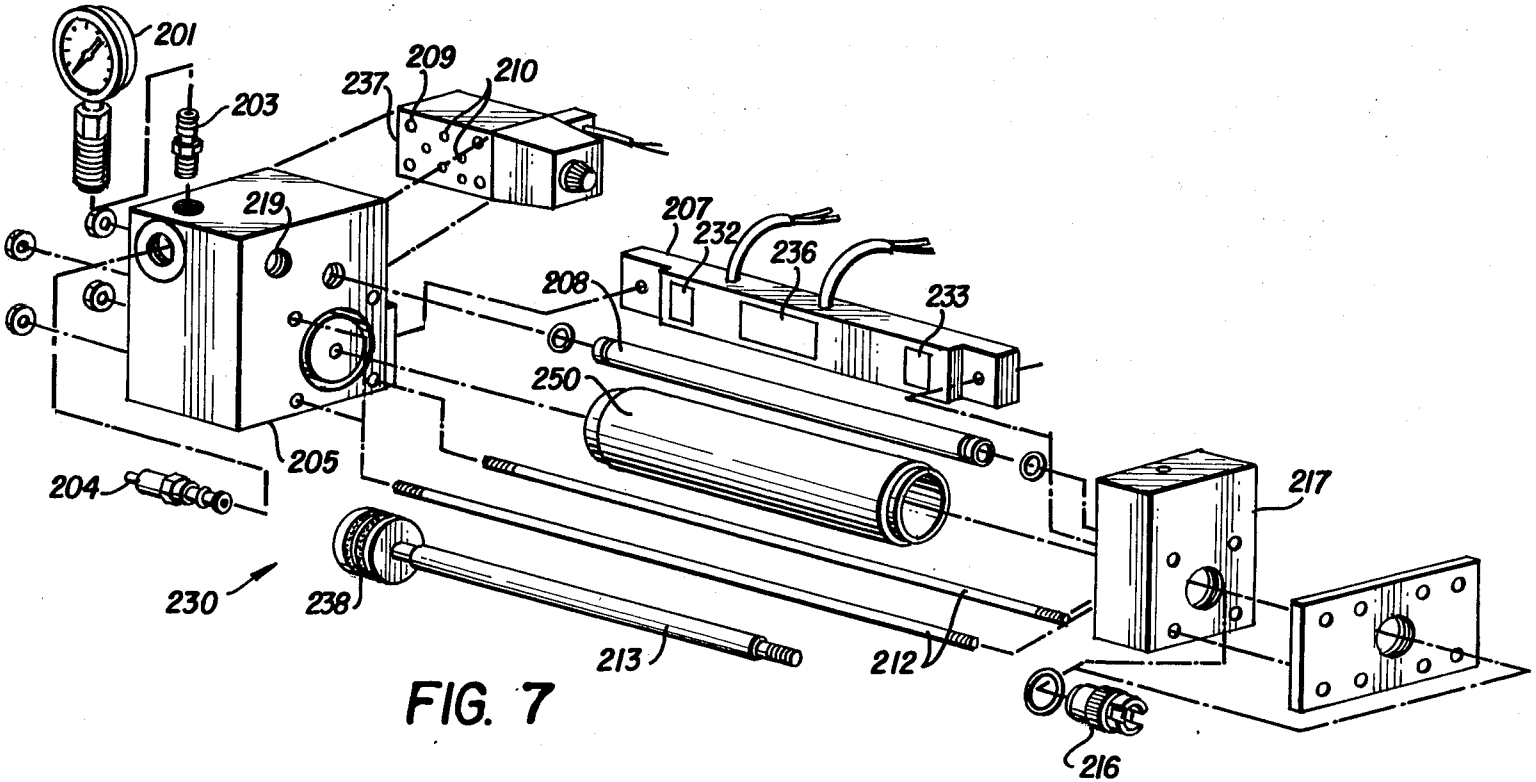
FIG. 7 is an exploded view of another embodiment of the hydraulic piston and drive cylinder assembly of the present invention.

FIG. 7 is an alternate embodiment of my invention wherein a great number of the aforementioned separate fluid pumping assembly components (FIGS. 4 and 5) items (130–139) are located on one uniquely self-contained combination hydraulic drive cylinder and electric control network assembly.

This embodiment offers several advantages over my first embodiment shown in FIGS. 4 and 5. Versatility is improved by reducing the requirement for hard electrical wiring and component space requirements. Interchangeability is improved for the same reason and serviceability is improved by reducing the amount of training required for the ordinary user to replace defective components (or replace the whole assembly) because of my central and contiguous locations of all functional members and components involved in the control network of the unit.

My FIG. 7 alternate embodiment is similar to my previous FIG. 4–6 embodiment in that, up to a point, the electrical and hydraulic network are similarly applied and they function similarly in operation, so like parts have in some instances, been assigned like reference numerals. One major difference is that while the hydraulic cylinder 250 is again fabricated of non-magnetic material, such as brass, proximity switches 132, 133 may be replaced, respectively, with magnet-responsive reed-type switches 232, 233 such as are available in the combination "open" or "closed" version as Model 5802, Form C from Hamlin, Inc., Lake Mills, Wis. These reed-type proximity switches are directly responsive to magnetic material which may be encapsulated in hydraulic piston 213 such as at point 238. The magnetic pull exerted by the magnetic material in the piston acts to draw the two thin metal reeds (similar to metal plates) together into electrical contact.

The top manifold 205 of the hydraulic drive cylinder assembly 230 is machined from a soft alloy such as aluminum and has provisions (4 screws) for the mounting of solenoid controlled directional valve 237 in juxtaposition to and contiguously with the top manifold 205, pressure reducing valve 204, and hydraulic test gauge connector 203 for hydraulic gage 201. Incorporated into top manifold 205 are all necessary communicating hydraulic passageways for the operation of these components, and a single spool valve is reciprocally moved within solenoid valve 237 to make the reciprocating hydraulic connections shown schematically at 137 in FIG. 6. Also attached to top manifold 205 is hydraulic cylinder tube 250 which houses hydraulic piston and rod assembly 213. Attached to the other end of cylinder tube 250 is the bottom manifold 217. The bottom manifold 217 has provisions for the mounting of piston rod gland seal 216 and also the communications tube 208 through which hydraulic fluid is ported to the bottom side of the hydraulic piston 213. The top manifold 205 and bottom manifold 217 are assembled with the cylinder tube 250 inbetween and held in position by a plurality of cylinder tie rods 212. The reciprocation of the magnetized piston 213 is sensed and controlled by the electronic directional control board 207, the electrical circuitry of which is again represented and may be understood schematically by reference to FIG. 6 and which contains electric proximity switches 232 and 233 corresponding respectively to switches 132 and 133 in FIG. 6. Relay assembly 236 and the two proximity switches 232, 233 are mounted within control board 207 beneath the smooth exterior surface thereof and are electrically connected together as in FIG. 6 by an appropriate circuit board which connects all components electrically as shown in FIG. 6.

In operation, hydraulic fluid enters inlet port 219 from variable volume pressure compensated hydraulic pump (143) and is directed through pressure reducing valve 204 where the hydraulic pressure is adjusted and set. Hydraulic oil is then ported through the interior passageways of manifold 205 to the spool of directional solenoid valve 237. Valve 237 is mounted by four Allen head socket screws (cooperating mounting holes 209 shown in FIG. 7) directly onto the side of top manifold 205 so as to be in close juxtaposition thereto and integral therewith. In my preferred embodiment, this is accomplished by four hydraulic oil communication ports 210 linking the spool (not shown, but schematically indicated at 137) of solenoid valve 237 with corresponding ports (not shown) on the outer, facing surface of upper manifold 205. When solenoid valve 237 is in its deenergized state, it ports oil to the communications tube 208 (without the necessity of hydraulic line 138) which communicates the oil and oil pressure to the bottom manifold 217 and then to the lower side of the magnet-carrying hydraulic drive piston assembly 213 causing it to retract within hydraulic cylinder 250. When the magnetized piston reaches the top of its stroke in the proximity of switch 232 which is located beneath the surface and within the electronic direction control board 207, switch 232 is caused to activate due to the magnetic pull exerted by the magnetic portion of the piston assembly 213. When switch 232 closes, the electrical circuit is completed since proximity switches 232 and 233 are again connected in series as in FIG. 6. Once the circuit is closed, the relay 236 is energized causing the two sets of electrical contacts 178–179 and 180–181 to close. Alternately, coil 140 of FIG. 6 may be replaced by two relay coils (not shown) and two switches, one such electrical relay coil being for a first switch and contacts 180–181 and the other such relay coil being for a second switch and contacts 178–179. If two relay coils are used, they may be connected in parallel, thereby still being immediately connected to and energized through electrical wires 192 and 193. In any case, one set of contacts 178–179 causes the solenoid directional control valve 237 to energize shifting the solenoid's spool to its secondary position and changing the direction of the flow of hydraulic oil and porting it to the top side of the piston assembly 213 without the necessity of hydraulic line 139 which has been replaced by selectively communicating hydraulic ports in manifold 205 and valve 237 (schematically represented at 137 in FIG. 6) causing piston assembly 213 to extend. The other set of relay-controlled electrical contacts 180–181, through the unique electrical latching wiring network described hereinabove with reference to FIG. 6, latches and holds the relay coil or coils 140 in the energized position as the piston starts down, even after the piston and rod assembly 213 moves out of the sensing range of proximity switch 232 and said switch has reopened. When the piston and rod assembly 213 comes into sensing range of proximity switch 233, such that proximity switch 233 is caused to open, the electrical circuit is broken releasing the relay coil or coils 140 and breaking both sets of contacts 178-179 and 180-181 thereby deenergizing the holding or latching circuit and deenergizing the solenoid directional control valve 237 which causes the spring in the solenoid to shift the spool of the solenoid valve to its normal primary position and reverses the flow of oil to underneath piston 213 and thereby reverses the direction of the piston and rod assembly 213 causing the piston and rod assembly 213 to retract, completing the cycle preparatory to a new cycle.

While the invention has been described with reference to certain specific embodiments thereof, it is not intended to be so limited thereby, and modifications and substitutions of equivalents will be apparent to those having ordinary skill in the art and are intended to be covered by the inventive concept claimed herein.

INDUSTRIAL APPLICABILITY

The present invention has application in the spraying of coatings, particularly in applying viscous sealing fluids on roadway pavement and parking lots. Another embodiment has application generally to pumps or other industry needs for reciprocating mechanisms that reciprocate in operation through a hydraulically operated control circuit, such as, for example, feeding of materials from one point to another, or placing tops on bottles, for another example.

I claim:

1. A hydraulic drive cylinder assembly comprising top and bottom manifolds and a hydraulic cylinder tube mounted therebetween fabricated of non-magnetic material, said manifolds having hydraulic oil communication ports formed therein, a hydraulic piston within the said hydraulic cylinder tube comprising, at least in part, magnetic material; upper and lower magnetic-responsive reed-type proximity limit switches positioned at either end of said cylinder and electrically responsive through combination electric network means and hydraulic network means to the presence of the magnetic material in the hydraulic piston to alternately activate solenoid valve means connected to hydraulic pressure generating means from a first position in which said solenoid valve means directs said hydraulic piston in one direction to a second solenoid valve means position in which said solenoid valve means directs said hydraulic piston in the other direction of a reciprocating cycle, said solenoid valve means having selectively communicating hydraulic oil passageways on the exterior surface thereof in matching alignment with selectively communicating hydraulic oil passageways formed in said top manifold, said solenoid valve means being mounted immediately juxtaposition to and integrally and contiguously with said top manifold by fastener means to provide selectively communicating hydraulic oil pathways between said top manifold and said solenoid valve means, thus ease of replacement is facilitated, interchangeability and serviceability are improved, and requirements for hard electrical wiring and hydraulic drive cylinder assembly component space requirements are reduced.

2. A materials pumping system comprising:

a double acting piston pump comprising upper and lower plunger assemblies comprising, respectively, an upper plunger and a lower plunger;

said pump being mounted for vertical reciprocation responsive to a mechanical force;

combination electrical network means and hydraulic network means to provide said mechanical force;

magnetically responsive proximity switch means linked together in direct electrical series connection and forming, in combination with electrical relay assembly means and solenoid directional control valve means, at least part of said electrical network means;

said proximity switch means comprising one normally open switch means and one normally closed switch means;

said combination electrical network means and hydraulic network means being provided with means to alternately act through said magnetically responsive proximity switch means and said direct electrical series connection to provide alternating signals to reciprocating motive force means to reciprocate said piston pump by detecting the presence of magnetic piston means within a hydraulic cylinder as part of said network means;

alternate detection of the presence of said magnetic piston means by said proximity switch means acting through said electrical network means and said hydraulic network means to continuously reciprocate said piston pump.

3. The invention of claim 2 wherein said upper plunger assembly and said lower plunger assembly are interconnected by a pump shaft, said lower plunger assembly comprising a pumping head cage, a check ball, and leather seals separated by spacers and sealingly engaging the sides of a lower pump housing.

4. The invention of claim 3 wherein, for most efficient and consistent operation, said pump is vertically mounted on an axis approximately perpendicular to the center of the earth whereby said plunger assemblies are operable to pump material to a spray means incorporating a spray nozzle with a flat, wide-angle spray pattern.

5. A materials pumping system for viscous materials comprising:

a double acting piston pump comprising an upper pump housing mounting an upper plunger assembly for reciprocation therein and a lower pump housing mounting a combination lower plunger assembly and pumping head cage for reciprocation therein, a pump shaft connecting said upper plunger assembly to said pumping head cage and said lower plunger assembly;

said plunger assemblies and pump shaft being mounted for vertical reciprocation, both said plunger assemblies having seal means acting in sliding engagement with inside housing surfaces of their respective pump housings, said upper pump housing being open to the atmosphere at an upper end thereof, pump reciprocating drive means comprising a hydraulic drive cylinder assembly connected by a piston rod to the upper plunger assembly and also to the lower plunger assembly;

combination electrical network means and hydraulic network means to provide means to reciprocate said pump;

magnetically responsive proximity switch means located juxtaposition said hydraulic drive cylinder assembly near opposite ends thereof to provide reciprocating control means for said drive cylinder assembly;

control network means comprising said proximity switch means, solenoid directional valve means and electrical relay assembly means;

said control network means being actuated responsive to the physical location of a ferro-magnetic drive piston within said hydraulic drive cylinder assembly to alternately actuate said proximity switch means to reciprocate said pump, said control network means further comprising means to protect the seal means of said upper plunger assembly from being damaged from contact with encrusted viscous material which may harden on the inside surface of said upper pump housing, said further means to protect comprising means comprising part of said control network means to positively return said drive piston and said upper and lower plunger assemblies to their uppermost reciprocating positions when said control network means is deactuated to thereby prohibit said upper plunger assembly from coming to rest in another position and to thereby protect the seal means of the upper plunger assembly.

6. An improved control network for hydraulic drive cylinder means comprising:

a non-magnetic hydraulic drive cylinder tube containing magnetic piston means and piston shaft means slidingly mounted therein for linear reciprocation, said piston means dividing said tube into upper and lower chambers for alternately receiving hydraulic fluid to drive said piston means in first one direction and then the other direction to achieve reciprocation of said piston shaft, one normally open proximity limit switch means having two electrical leads, said switch being located near one end of said non-magnetic cylinder tube, one normally closed proximity limit switch means having two electrical leads, said last mentioned switch means being located near the other end of said non-magnetic cylinder tube, one electrical lead of said normally open switch directly electrically series connected to one electrical lead of said normally closed switch, electrical relay assembly means electrically connecting said series connected proximity switches and also electrically connected to solenoid directional control valve means and a direct current power source, said electrical relay assembly means comprising relay coil means to actuate throw switch assembly means to alternately energize and deenergize said solenoid directional control valve means responsive to alternating electrical signals from said proximity switch means, said proximity limit switch means, said electrical relay assembly means, said direct electrical series connection between said proximity switch means, said direct current power source and said solenoid directional control valve means comprising an electrical network, said solenoid valve means operable in a hydraulic network supplying hydraulic fluid from a variable volume pressure compensated hydraulic pump to a first chamber of said drive cylinder when said solenoid valve means is in a first position and to a second chamber of said drive cylinder when said solenoid valve means is in a second position, said magnetic piston and piston shaft of said drive cylinder being continuously reciprocated through the operation and interaction of the combination hydraulic network and electric network, which two networks together comprise a control network, to drive work means requiring a reciprocating power stroke

7. The control network of claim 4 wherein said solenoid valve means is detachably mounted directly onto the side of a manifold of said hydraulic drive cylinder means, said manifold being mounted on said hydraulic drive cylinder tube and enclosing one end of one chamber thereof, and hydraulic pathway control and interconnection is made between said solenoid valve and said manifold through oppositely facing, selectively communicating hydraulic oil ports on the exterior surfaces of said solenoid valve means and said manifold.

8. A portable apparatus for spraying asphalt or coal-tar-pitch emulsions comprising:

a reservoir containing said emulsion, a fluid pumping assembly vertically mounted on said apparatus and comprised of a hydraulic drive cylinder assembly, a vertical lift double acting piston pump comprising an upper pump housing containing an upper plunger assembly, a lower pump housing containing a lower plunger assembly, said lower plunger assembly comprising pumping head cage means containing an upper check ball valve, the lower end of said double acting piston pump having lower check ball valve means;

said upper plunger assembly and said lower plunger assembly being substantially coaxially aligned, a pump shaft coaxially aligned with, connected to, and powered by a movable reciprocating hydraulic piston and piston rod within said hydraulic drive cylinder, said pump shaft also being substantially coaxially aligned with and connected to said upper and lower plunger assemblies, said hydraulic drive cylinder having upper and lower ends and being fabricated of non-magnetic material and a hydraulic piston mounted for reciprocation within said hydraulic drive cylinder comprising, at least in part, magnetic material, an upper, normally open proximity switch mounted on said hydraulic drive cylinder near one end thereof, and a second, normally closed proximity switch mounted on said hydraulic drive cylinder near the other end thereof, said normally open proximity switch being directly electrically series connected to said normally closed proximity switch, said upper and lower proximity switches being electrically responsive through combination electric network means and hydraulic network means to the magnetic material of said hydraulic piston to reciprocate said piston by alternately activating solenoid directional control valve means comprising part of said hydraulic network means to continuously alternate the directional flow of hydraulic fluid supplied by a hydraulic pressure-generating means to opposite ends of said hydraulic drive cylinder, said solenoid directional control valve means occupying a first position when said proximity switches are in their respective normal positions to thereby direct hydraulic fluid to one end of said hydraulic drive cylinder to move said piston in a first direction, said normally open proximity switch closing in a second position in response to the presence of said magnetic material of said piston to complete electric network means through said direct electrical series connection between said proximity switches to activate said solenoid control valve means to a second position to direct hydraulic fluid to the other end of said hydraulic drive cylinder, said electric network means and said hydraulic network means acting together to alternately reciprocate said piston, said pump shaft and said plunger assemblies.

9. The apparatus for spraying of claim 8 wherein said solenoid valve means is detachably mounted directly onto the side of a manifold of said hydraulic drive cylinder assembly, said manifold being mounted on said hydraulic drive cylinder and enclosing one end of said cylinder, and hydraulic pathway control and interconnection is made between said solenoid valve means and said manifold through oppositely facing, selectively communicating hydraulic oil ports on the exterior surfaces of said solenoid valve means and said manifold.

10. A method for controlling the flow and pressure requirements of apparatus for spraying asphalt or coal-tar-pitch emulsion material comprising:

providing a reservoir containing said emulsion, providing spray means for spraying said emulsion, providing an on-off valve means for controlling the flow of emulsion to said spray means, providing pumping means for pumping said emulsion through discharge line means to said on-off valve and thence to said spray means, providing hydraulic drive cylinder means to reciprocate a materials pump and thereby pump said emulsion to said spray means, controlling and operating said apparatus so that the discharge volume of emulsion at the spray means is less than the pressure and volume of emulsion being generated and supplied by the materials pump thus creating an "over supply" of emulsion in said discharge line upstream of said on-off valve, the resulting rise in material pressure within said materials pump causing a corresponding rise in hydraulic pressure in the hydraulic drive cylinder means, providing variable volume pressure compensated hydraulic pump means controlled and actuated by electrical circuit means to reciprocate said hydraulic drive cylinder means, said hydraulic pump means and said hydraulic cylinder means comprising hydraulic fluid system means, providing sensing means and operating said apparatus for spraying so that said rise in hydraulic pressure in said hydraulic drive cylinder means causes said variable volume pressure compensated hydraulic pump to reduce its volume of a hydraulic oil being pumped and supplied to said hydraulic drive cylinder means so as to maintain a preset, maximum compensated pressure (e.g. 650 psi) in the hydraulic fluid system means, said reduction in volume in turn reducing the hydraulic oil supply to the reciprocating hydraulic drive cylinder means thereby causing the drive cylinder means to reduce its speed of reciprocation, thereby in turn reducing and regulating the speed of the materials pump driven by said hydraulic drive cylinder means which in turn decreases the materials pressure in the discharge line thereby controlling said discharge line pressure to a maximum preset emulsion material pressure of, for example, approximately 70 psi, which corresponds to a maximum preset design pressure in the hydraulic fluid system means of, for example, the previously mentioned 650 psi, whereby when the apparatus for spraying emulsion is again turned on at the on-off valve by the operator, the emulsion pressure immediately falls activating said sensing means and causing the variable volume pressure compensated hydraulic pump to again begin to supply the hydraulic drive cylinder with hydraulic oil to automatically maintain material pressure in response to the volume of material flow.

11. An improved hydraulic drive cylinder control network for a hydraulic drive cylinder assembly comprising:

a non-magnetic hydraulic drive cylinder tube containing a magnetic piston and piston shaft slidingly mounted therein for linear reciprocation, one normally open proximity limit switch having at least two electrical leads, said switch being located near one end of said non-magnetic cylinder tube and said open switch moving to a closed position responsive to close physical proximity to said magnetic piston, one normally closed proximity limit switch having at least two electrical leads, said last mentioned switch being located near the other end of said non-magnetic cylinder tube and said closed switch moving to an open position responsive to close physical proximity to said magnetic piston, one electrical lead of said normally open proximity limit switch being connected in a direct electrical series connection to one electrical lead of said normally closed proximity limit switch, an electrical relay assembly means having relay coil means directly electrically connected to a second electrical lead of said normally closed proximity limit switch, said relay coil means also being electrically connected to a direct current power source, said electrical relay assembly means also comprising switch assembly means electrically connected to a second electrical lead of said normally open proximity limit switch, said switch assembly means also electrically connected to a solenoid directional control valve and said direct current power source, said proximity limit switches, said electrical relay assembly means, said relay coil means, said switch assembly means, said direct current power source, said solenoid directional control valve, and said electrical connections comprising an electrical network for said hydraulic drive cylinder assembly, said solenoid valve operable in a hydraulic network supplying hydraulic fluid from a hydraulic oil pump to a first chamber of said drive cylinder when said solenoid valve is in a first position and to a second chamber of said drive cylinder when said solenoid valve is in a second position, said magnetic piston and piston shaft of said drive cylinder being actuated through the operation and interaction of the combination hydraulic network and electric network, which two networks together comprise a control network, to drive work means requiring a reciprocating power stroke.

12. The invention of claim 1 wherein said solenoid valve is detachably mounted directly onto the side of a manifold of said hydraulic drive cylinder assembly and hydraulic pathway interconnection is made between said solenoid valve and said manifold through oppositely facing, selectively communicating hydraulic oil ports on the exterior surfaces of said solenoid valve and said manifold.

13. An improved hydraulic drive cylinder control network for a hydraulic drive cylinder assembly comprising:

a non-magnetic hydraulic drive cylinder tube containing a magnetic piston and piston shaft slidingly mounted therein for linear reciprocation, one normally open proximity limit switch located near one end of said non-magnetic cylinder tube, one normally closed proximity limit switch located near the other end of said non-magnetic cylinder, said proximity limit switches being directly electrically connected in electrical series, an electrical relay assembly electrically connected to said proximity switches and also electrically connected to a solenoid directional control valve, said proximity limit switches, said direct electrical series connection between said proximity switches, said relay assembly, and said solenoid directional control valve comprising an electrical network, said solenoid valve operable in a hydraulic network supplying hydraulic oil from a variable volume pressure compensated hydraulic pump to a first chamber of said drive cylinder when said solenoid valve is in a first position and to a second chamber of said drive cylinder when said solenoid valve is in a second position, said variable volume pressure compensated hydraulic pump being set to run at a constant, pre-set speed, the volume displacement of hydraulic oil of said pump being controlled by adjustable valve means located in said hydraulic network between said pump and said solenoid valve, adjustment of said valve means providing variable speed regulation of the speed of reciprocation of said magnetic piston within said hydraulic drive cylinder assembly, said magnetic piston and piston shaft of said drive cylinder being actuated through the operation and interaction of the combination hydraulic network and electric network, which two networks together comprise the improved hydraulic drive cylinder control network, to drive work means requiring a reciprocating power stroke.

14. The invention of claim 13 wherein said adjustable valve means comprises an adjustable needle valve, adjustment of said needle valve providing a speed control means for controlling the speed of reciprocation of said hydraulic drive cylinder assembly, said speed control means possessing an infinite intermediate speed regulation, for example, between 0 and 60 cycles per minute.

15. The invention of claim 14 wherein said hydraulic network further comprises bypass line means and relief valve means in said bypass line means, said bypass line means and said relief valve means linking the output of said variable volume pressure compensated hydraulic pump and a hydraulic oil reservoir to provide safe operation of said hydraulic network.

16. The control network of claim 13 wherein said solenoid valve is detachably mounted directly onto the side of a manifold of said hydraulic drive cylinder assembly, said manifold being mounted on said hydraulic drive cylinder and enclosing one end of said cylinder, and hydraulic pathway control and interconnection is made between said solenoid valve and said manifold through oppositely facing, selectively communicating hydraulic oil ports on the exterior surfaces of said solenoid valve and said manifold.

17. An improved hydraulic drive cylinder control network for a hydraulic drive cylinder assembly comprising:

a non-magnetic hydraulic drive cylinder tube containing a magnetic piston and piston shaft slidingly mounted therein for linear reciprocation, one normally open proximity limit switch having at least two electrical leads, said switch being located near one end of said non-magnetic cylinder tube, one normally closed proximity limit switch having at least two electrical leads, said last mentioned switch being located near the other end of said non-magnetic cylinder tube, one electrical lead of said normally open proximity limit switch being connected in a direct electrical series connection to one electrical lead of said normally closed proximity limit switch, an electrical relay assembly means having relay coil means directly electrically connected to a second electrical lead of said normally closed proximity limit switch, said relay coil means also being electrically connected to a direct current power source, said electrical relay assembly means also comprising switch assembly means electrically connected to a second electrical lead of said normally open proximity limit switch, said switch assembly means also electrically connected to a solenoid directional control valve and said direct current power source.

said proximity limit switches, said electrical relay assembly means, said relay coil means, said switch assembly means, said direct current power source, said solenoid directional control valve, and said electrical connections comprising an electrical network for said hydraulic drive cylinder assembly, said electrical relay assembly means and said proximity switches being mounted within and below a smooth exterior surface of an electronic control board, and, said control board, said solenoid valve, and said drive cylinder being assembled in one self-contained, contiguous, integral and juxtapositioned assembly whereby ease of replacement of said assembly is facilitated, interchangeability and serviceability are improved, and requirements for hard electrical wiring and hydraulic drive cylinder assembly component space are reduced, said solenoid valve operable in a hydraulic network supplying hydraulic fluid from a hydraulic oil pump to a first chamber of said drive cylinder when said solenoid valve is in a first position and to a second chamber of said drive cylinder when said solenoid valve is in a second position, said magnetic piston and piston shaft of said drive cylinder being actuated through the operation and interaction of the combination hydraulic network and electric network, which two networks together comprise a control network, to drive work means requiring a reciprocating power stroke.

18. The control network of claim 17, wherein said normally open and normally closed proximity switches are magnet-responsive reed-type switches.

19. An improved hydraulic drive cylinder control network for a hydraulic drive cylinder assembly comprising:

a non-magnetic hydraulic drive cylinder tube containing a magnetic piston and piston shaft slidingly mounted therein for linear reciprocation, one normally open proximity limit switch having at least two electrical leads, said switch being located near one end of said non-magnetic cylinder tube, one normally closed proximity limit switch having at least two electrical leads, said last mentioned switch being located near the other end of said non-magnetic cylinder tube, one electrical lead of said normally open proximity limit switch being connected in a direct electrical series connection to one electrical lead of said normally closed proximity limit switch, an electrical relay assembly means having relay coil means directly electrically connected to a second electrical lead of said normally closed proximity limit switch, said relay coil means also being electrically connected to a direct current power source, said electrical relay assembly means also comprising switch assembly means electrically connected to a second electrical lead of said normally open proximity limit switch, said switch assembly means also electrically connected to a solenoid directional control valve and said direct current power source, said proximity limit switches, said electrical relay assembly means, said relay coil means, said switch assembly means, said direct current power source, said solenoid directional control valve, and said electrical connections comprising an electrical network for said hydraulic drive cylinder assembly, said solenoid valve operable in a hydraulic network supplying hydraulic fluid from a hydraulic oil pump to a first chamber of said drive cylinder when said solenoid valve is in a first position and to a second chamber of said drive cylinder when said solenoid valve is in a second position, said magnetic piston and piston shaft of said drive cylinder being actuated through the operation and interaction of the combination hydraulic network and electric network, which two networks together comprise a control network, to drive work means requiring a reciprocating power stroke, and means within the control network to return said magnetic piston to a position retracted within said drive cylinder assembly when said solenoid valve and said electrical relay assembly means are deenergized to thereby achieve a desired and predetermined condition in said work means when said magnetic piston is stopped at a selected end of its stroke.

20. An improved hydraulic drive cylinder control network for a hydraulic drive cylinder assembly comprising:

a non-magnetic hydraulic drive cylinder tube containing a magnetic piston and piston shaft slidingly mounted therein for linear reciprocation, one normally open proximity limit switch having at least two electrical leads, said switch being located near one end of said non-magnetic cylinder tube, one normally closed proximity limit switch having at least two electrical leads, said last mentioned switch being located near the other end of said non-magnetic cylinder tube, one electrical lead of said normally open proximity limit switch being connected in a direct electrical series connection to one electrical lead of said normally closed proximity limit switch, an electrical relay assembly means having relay coil means directly electrically connected to a second electrical lead of said normally closed proximity limit switch, said relay coil means also being electrically connected to a direct current power source, said electrical relay assembly means also comprising switch assembly means electrically connected to a second electrical lead of said normally open proximity limit switch, said switch assembly means also electrically connected to a solenoid directional control valve and said direct current power source, said proximity limit switches, said electrical relay assembly means, said relay coil means, said switch assembly means, said direct current power source, said solenoid directional control valve, and said electrical connections comprising an electrical network for said hydraulic drive cylinder assembly, said solenoid valve operable in a hydraulic network supplying hydraulic fluid from a hydraulic oil pump to a first chamber of said drive cylinder when said solenoid valve is in a first position and to a second chamber of said drive cylinder when said solenoid valve is in a second position, said switch assembly means comprising a double pole double throw switch, said throw switch being alternately actuatable into a make-contact electrical circuit position and a break-contact open circuit position respectively when said solenoid valve is respectively in said solenoid valve's second position and said solenoid valve's first position, said magnetic piston and piston shaft of said drive cylinder being actuated through the operation and interaction of the combination hydraulic network and electric network, which two networks together comprise a control network, to drive work means requiring a reciprocating power stroke.

21. An improved hydraulic drive cylinder control network for a hydraulic drive cylinder assembly comprising:

a non-magnetic hydraulic drive cylinder tube containing a magnetic piston and piston shaft slidingly mounted therein for linear reciprocation, one normally open proximity limit switch having at least two electrical leads, said switch being located near one end of said non-magnetic cylinder tube, one normally closed proximity limit switch having at least two electrical leads, said last mentioned switch being located near the other end of said non-magnetic cylinder tube, one electrical lead of said normally open proximity limit switch being connected in a direct electrical series connection to one electrical lead of said normally closed proximity limit switch, an electrical relay assembly means having relay coil means directly electrically connected to a second electrical lead of said normally closed proximity limit switch, said relay coil means also being electrically connected to a direct current power source, said electrical relay assembly means also comprising switch assembly means electrically connected to a second electrical lead of said normally open proximity limit switch, said switch assembly means also electrically connected to a solenoid directional control valve and said direct current power source, said proximity limit switches, said electrical relay assembly means, said relay coil means, said switch assembly means, said direct current power source, said solenoid directional control valve, and said electrical connections comprising an electrical network for said hydraulic drive cylinder assembly, said solenoid valve operable in a hydraulic network supplying hydraulic fluid from a hydraulic oil pump to a first chamber of said drive cylinder when said solenoid valve is in a first position and to a second chamber of said drive cylinder when said solenoid valve is in a second position, and positive reciprocation means for eliminating stalling of the magnetic piston means in mid-stroke and for returning said magnetic piston means to an up-stroke position when said solenoid valve and said electrical relay assembly means are deenergized, said positive reciprocation means comprising a single solenoid directional control valve assembly of the two position spring offset type, said single solenoid directional control valve being biased in a normal, deenergized position when said electrical relay assembly means is also in a deenergized position, to provide hydraulic fluid flow through said solenoid valve from said hydraulic pump to said lower chamber of said drive cylinder tube to thereby raise said magnetic piston means to the up-stroke position when said solenoid valve and said relay assembly means are electrically deenergized, said magnetic piston and piston shaft of said drive cylinder being actuated through the operation and interaction of the combination hydraulic network and electric network, which two networks together comprise a control network, to drive work means requiring a reciprocating power stroke.

22. An improved hydraulic drive cylinder control network for a hydraulic drive cylinder assembly comprising:

a non-magnetic hydraulic drive cylinder tube containing a magnetic piston and piston shaft slidingly mounted therein for linear reciprocation, one normally open proximity limit switch having at least two electrical leads, said switch being located near one end of said non-magnetic cylinder tube, one normally closed proximity limit switch having at least two electrical leads, said last mentioned switch being located near the other end of said non-magnetic cylinder tube, one electrical lead of said normally open proximity limit switch being connected in a direct electrical series connection to one electrical lead of said normally closed proximity limit switch, an electrical relay assembly means having relay coil means directly electrically connected to a second electrical lead of said normally closed proximity limit switch, said relay coil means also being electrically connected to a direct current power source, said electrical relay assembly means also comprising switch assembly means electrically connected to a second electrical lead of said normally open proximity limit switch, said switch assembly means also electrically connected to a solenoid directional control valve and said direct current power source, and electrical latching (i.e. self-holding) means for maintaining said switch assembly means in a closed position even after said magnetic piston leaves the magnetic proximity of said normally open proximity limit switch, said latching means holding said switch assembly means in said closed position until such time as said magnetic piston comes into the proximity of said normally closed proximity switch, whereupon said electrical latching means is released, said proximity limit switches, said electrical relay assembly means, said relay coil means, said switch assembly means, said electrical latching (i.e. self-holding) means, said direct current power source, said solenoid directional control valve, and said electrical connections comprising an electrical network for said hydraulic drive cylinder assembly, said solenoid valve operable in a hydraulic network supplying hydraulic fluid from a hydraulic oil pump to a first chamber of said drive cylinder when said solenoid valve is in a first position and to a second chamber of said drive cylinder when said solenoid valve is in a second position, said magnetic piston and piston shaft of said drive cylinder being actuated through the operation and interaction of the combination hydraulic network and electric network, which two networks together comprise a control network, to drive work means requiring a reciprocating power stroke.

23. An improved hydraulic drive cylinder control network for a hydraulic drive cylinder assembly comprising:

a non-magnetic hydraulic drive cylinder tube containing a magnetic piston and piston shaft slidingly mounted therein for linear reciprocation, one normally open proximity limit switch having at least two electrical leads, said switch being located near one end of said non-magnetic cylinder tube, one normally closed proximity limit switch having at least two electrical leads, said last mentioned switch being located near the other end of said non-magnetic cylinder tube, one electrical lead of said normally open proximity limit switch being connected in a direct electrical series connection to one electrical lead of said normally closed proximity limit switch, an electrical relay assembly means having relay coil means directly electrically connected to a second electrical lead of said normally closed proximity limit switch, said relay coil means also being electrically connected to a direct current power source, said electrical relay assembly means also comprising switch assembly means electrically connected to a second electrical lead of said normally open proximity limit switch, said switch assembly means also electrically connected to a solenoid directional control valve and said direct current power source, said proximity limit switches, said electrical relay assembly means, said relay coil means, said switch assembly means, said direct current power source, said solenoid directional control valve, and said electrical connections comprising an electrical network for said hydraulic drive cylinder assembly, said proximity switches and said electrical relay assembly means being physically consolidated and mounted within and below a smooth exterior surface of an electronic directional control board which is physically mounted in juxtaposition to and contiguously with said hydraulic drive cylinder assembly to thereby facilitate ease of replacement and to improve interchangeability and serviceability in field-use situations, said solenoid valve operable in a hydraulic network supplying hydraulic fluid from a hydraulic oil pump to a first chamber of said drive cylinder when said solenoid valve is in a first position and to a second chamber of said drive cylinder when said solenoid valve is in a second position, said magnetic piston and piston shaft of said drive cylinder being actuated through the operation and interaction of the combination hydraulic network and electric network, which two networks together comprise a control network, to drive work means requiring a reciprocating power stroke.

24. An improved control network for hydraulic drive cylinder means comprising:

a non-magnetic hydraulic drive cylinder tube containing magnetic piston means and piston shaft means slidingly mounted therein for linear reciprocation, said piston means dividing said tube into upper and lower chambers for alternately receiving hydraulic fluid to drive said piston means in first one direction and then the other direction to achieve reciprocation of said piston shaft, one normally open proximity limit switch means having two electrical leads, said switch being located near one end of said non-magnetic cylinder tube, one normally closed proximity limit switch means having two electrical leads, said last mentioned switch means being located near the other end of said non-magnetic cylinder tube, one electrical lead of said normally open switch directly electrically series connected to one electrical lead of said normally closed switch, electrical relay assembly means electrically connecting said series connected proximity switches and also electrically connected to solenoid directional control valve means and a direct current power source, said electrical relay assembly means comprising relay coil means to actuate throw switch assembly means to alternately energize and deenergize said solenoid directional control valve means responsive to alternating electrical signals from said proximity switch means, said proximity limit switch means, said electrical relay assembly means, said direct electrical series connection between said proximity switch means, said direct current power source and said solenoid directional control valve means comprising an electrical network, said electrical network further comprising electrical latching (i.e. self-holding) circuit means comprising said electrical relay assembly means, both said proximity switch means, said direct electrical series connection between said proximity switch means, said relay coil means, a pair of electrical contacts within said electrical relay assembly means, and interconnecting electrical wiring, the proximity of said magnetic piston means to said normally open proximity limit switch means acting to energize said relay assembly means and said relay coil means to thereby close said pair of electrical contacts of said electrical relay assembly means and complete a direct current circuit that remains closed and complete even after said piston commences reciprocation and leaves the proximity of said normally open proximity switch means to thereby cause said normally open proximity switch means to return to its normally open position, said direct current circuit remaining latched, closed and complete until such time as the further reciprocation of said piston brings said piston into the proximity of said normally closed proximity switch means to thereby open said last mentioned proximity switch means and open and deenergize said electrical latching circuit.

25. An improved control network for hydraulic drive cylinder means comprising:

a non-magnetic hydraulic drive cylinder tube containing magnetic piston means and piston shaft means slidingly mounted therein for linear reciprocation, said piston means dividing said tube into upper and lower chambers for alternately receiving hydraulic fluid to drive said piston means in first one direction and then the other direction to achieve reciprocation of said piston shaft, one normally open proximity limit switch means having two electrical leads, said switch being located near one end of said non-magnetic cylinder tube, one normally closed proximity limit switch means having two electrical leads, said last mentioned switch means being located near the other end of said non-magnetic cylinder tube, one electrical lead of said normally open switch directly electrically series connected to one electrical lead of said normally closed switch, electrical relay assembly means electrically connecting said series connected proximity switches and also electrically connected to solenoid directional control valve means and a direct current power source, said electrical relay assembly means comprising relay coil means to actuate throw switch assembly means to alternately energize and deenergize said solenoid directional control valve means responsive to alternating electrical signals from said proximity switch means, said proximity limit switch means, said electrical relay assembly means, said direct electrical series connection between said proximity switch means, said direct current power source and said solenoid directional control valve means comprising an electrical network, said solenoid valve means operable in a hydraulic network supplying hydraulic fluid from a variable volume pressure compensated hydraulic pump to a first chamber of said drive cylinder when said solenoid valve means is in a first position and to a second chamber of said drive cylinder when said solenoid valve means is in a second position, and positive reciprocation means to eliminate stalling of the magnetic piston means in mid-stroke and to automatically return said magnetic piston means to an up-stroke position when said solenoid valve means and said electrical relay assembly means are deenergized, said positive reciprocation means comprising providing a single solenoid directional control valve assembly of the two position spring offset type as the solenoid valve means, said single solenoid directional control valve being biased in a normal, deenergized position when said electrical relay assembly means is also in a deenergized position, to provide hydraulic fluid flow through said solenoid valve means from said hydraulic pump to said lower chamber of said drive cylinder tube to thereby raise said magnetic piston means to the up-stroke position when said solenoid valve means and said relay assembly means are electrically de-energized.

26. A hydraulic drive cylinder assembly comprising top and bottom manifolds and a hydraulic cylinder tube mounted therebetween fabricated of non-magnetic material, said manifolds having hydraulic oil communication ports formed therein, a hydraulic piston within the said hydraulic cylinder tube comprising, at least in part, magnetic material; upper and lower magnetic-responsive reed-type proximity limit switches positioned at either end of said cylinder and electrically responsive through combination electric network means and hydraulic network means to the presence of the magnetic material in the hydraulic piston to alternately activate solenoid valve means connected to hydraulic pressure generating means from a first position in which said solenoid valve means directs said hydraulic piston in one direction to a second solenoid valve means position in which said solenoid valve means directs said hydraulic piston in the other direction of a reciprocating cycle, said solenoid valve means having selectively communicating hydraulic oil passageways on the exterior surface thereof in matching alignment with selectively communicating hydraulic oil passageways formed in said top manifold, said solenoid valve means being mounted immediately juxtaposition to and integrally and contiguously with said top manifold by fastener means to provide selectively communicating hydraulic oil pathways between said top manifold and said solenoid valve means, thus ease of replacement is facilitated, interchangeability and serviceability are improved, and requirements for hard electrical wiring and hydraulic drive cylinder assembly component space requirements are reduced, said electric network means comprising electrical relay assembly means and said upper and lower magnetic-responsive reed-type proximity limit switches, said electrical relay assembly means and said proximity limit switches being mounted within and below a smooth exterior surface of an electronic directional control board, said electronic directional control board being immediately mounted to said manifolds to form one integral and contiguous unit therewith, said mounting also placing said electronic directional control board immediately juxtaposition said hydraulic cylinder tube, whereby ease of replacement of said control board is facilitated, interchangeability and serviceability are improved, and requirements for hard electrical wiring and hydraulic drive cylinder assembly component space requirements are reduced.

27. Materials pumping means for pressurizing and spraying viscous liquid materials comprising:

a double acting piston pump comprising an upper pump housing mounting an upper plunger assembly for reciprocation therein and a lower pump housing mounting a combination lower plunger assembly and pumping head cage for reciprocation therein, a pump shaft connecting said upper plunger assembly to said pumping head cage and said lower plunger assembly, said plunger assemblies and pump shaft being mounted for vertical reciprocation, both said plunger assemblies having seal means for moving in sealing engagement with inside housing surfaces of their respective pump housings, said upper pump housing being open to the outside atmosphere at an upper end thereof, reciprocating drive means for reciprocatingly driving said pump shaft and said plunger assemblies, control network means for controlling the reciprocation of said pump shaft and said plunger assemblies, said control network means incorporating means for protecting the seal means of said upper plunger assembly from being damaged from contact with encrusted viscous material which may harden on the inside surface of said upper pump housing due to exposure to the atmosphere, said means for protecting said seal means comprising means within said control network means for positively returning said pump shaft, said plunger assemblies, and said seal means to their uppermost vertical reciprocating positions responsive to deactuation of said control network means, said means for positively returning prohibiting said upper plunger assembly from coming to rest in another position and protecting the seal means of the upper plunger assembly.

* * * * *